United States Patent [19]

Hyland et al.

[11] 4,213,266

[45] Jul. 22, 1980

[54] TUMBLING TOY

[75] Inventors: Joseph F. Hyland; Barbara B. Hyland, both of Ridgewood, N.J.; A. Edward Fogarty; Bonnie R. Fogarty, both of Sarasota, Fla.; Frank A. Spinale, N. Attleboro, Mass.

[73] Assignee: Hasbro Industries, Inc., Pawtucket, R.I.

[21] Appl. No.: 879,908

[22] Filed: Feb. 21, 1978

[51] Int. Cl.[2] ..... A63H 33/00; A63H 15/08; A63B 37/00

[52] U.S. Cl. ..... 46/1 R; 46/43; 46/134; 273/58 F

[58] Field of Search ..... 46/1 R, 43, 134, 11; 273/86.3, 113, 120, 108, 58 F, 153 J, 154

[56] References Cited

U.S. PATENT DOCUMENTS

| | | | |
|---|---|---|---|
| 1,214,454 | 1/1917 | Gowdey | 46/134 |
| 1,254,428 | 1/1918 | Myers | 46/134 |
| 1,272,588 | 7/1918 | White | 46/134 |
| 1,373,312 | 3/1921 | Dickerson | 273/113 |
| 1,383,316 | 7/1921 | Liebert | 46/43 |
| 2,218,207 | 10/1940 | Herzinger | 46/134 |
| 2,585,780 | 2/1952 | Johnson | 46/134 |

FOREIGN PATENT DOCUMENTS

| | | | |
|---|---|---|---|
| 522545 | 12/1889 | Fed. Rep. of Germany | 46/134 |

*Primary Examiner*—Louis G. Mancene
*Assistant Examiner*—Michael J. Foycik, Jr.
*Attorney, Agent, or Firm*—Salter & Michaelson

[57] ABSTRACT

A tumbling toy having an end-over-end tumbling action and including a hollow housing having spaced end caps, an outer sleeve and an inner tubular member joined to the end caps and receiving a weighted ball for rolling action therein, the weighted ball having rolling movement between the end caps to produce the tumbling end-over-end action of the housing when an exterior force is applied thereto or when the tumbling toy is placed on a downwardly inclined surface.

13 Claims, 5 Drawing Figures

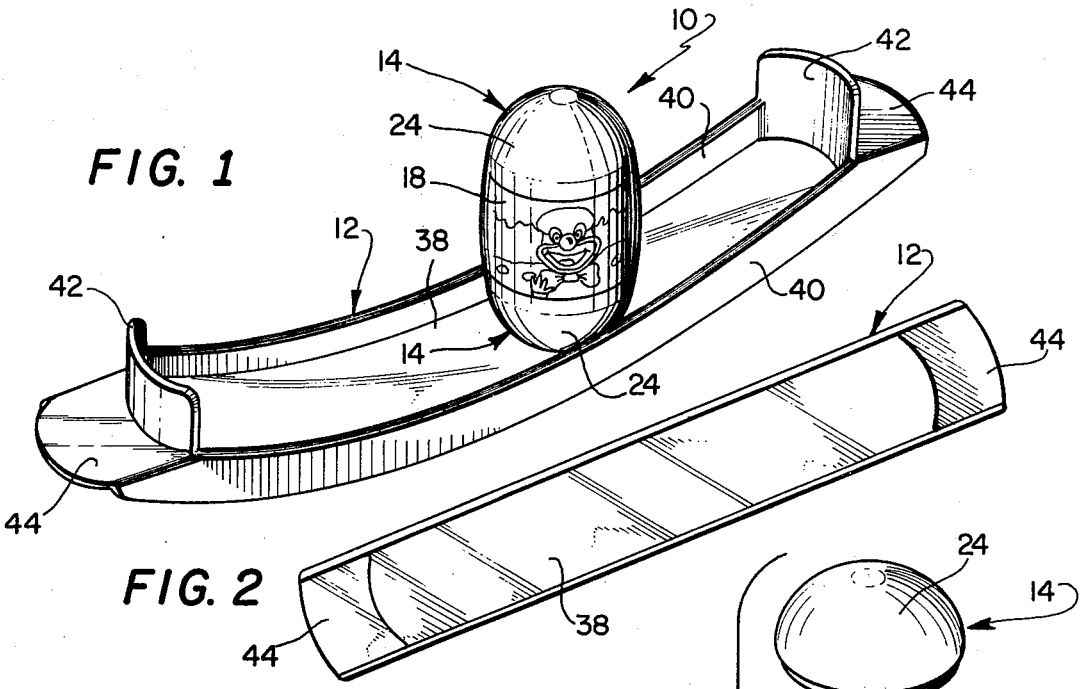
FIG. 1
FIG. 2
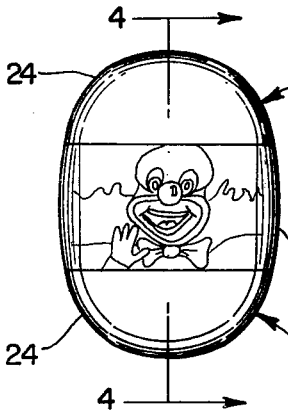
FIG. 3
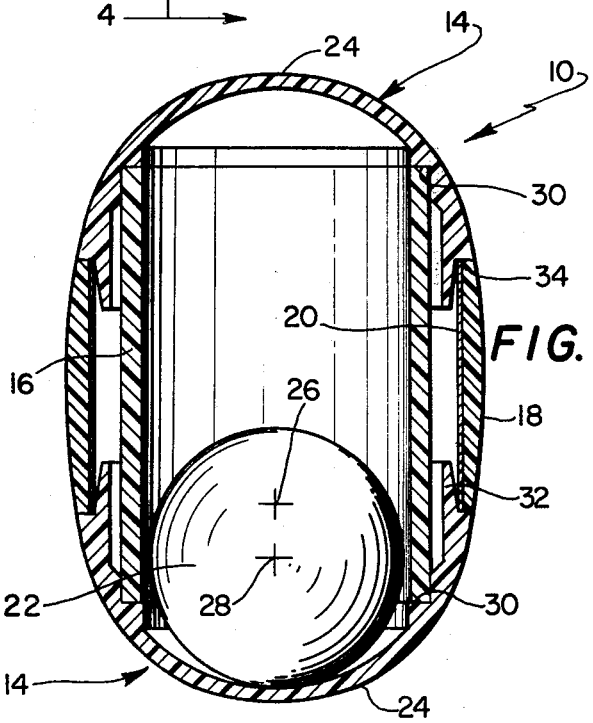
FIG. 4
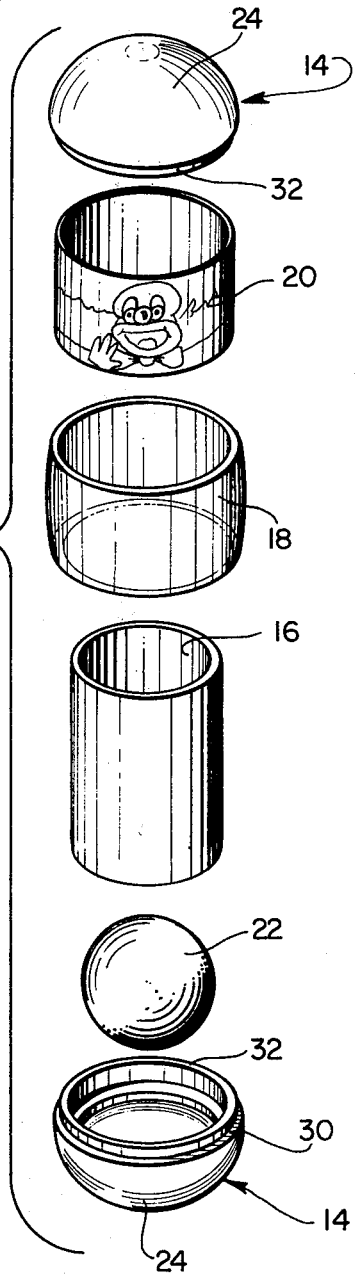
FIG. 5

TUMBLING TOY

BACKGROUND OF THE INVENTION

The present invention relates to a tumbling toy defined by a housing having a weighted ball disposed for rolling movement therein and that produces an end-over-end tumbling action of the toy.

Tumbling toys of the variety embodied in the subject invention are well known and are normally referred to as a "Mexican jumping bean". Prior known constructions have generally included an elongated housing having rounded end walls the curvature of which was designed to accommodate a weighted ball thereagainst. The weighted ball was movable between the end walls of the housing to produce the tumbling end-over-end action characteristic of the "jumping bean". Examples of this type of tumbling toy as represented by the prior issued U.S. Pat. Nos. are the patents to Gowdy #1,214,454, Meyers #1,254,428, White #1,272,588, Dickerson #1,373,312 and Johnson #2,585,780. Another example of a tumbling toy utilizing the concept of the "jumping bean" is the patent to Johnson #2,585,780.

All of the above referred to patents utilized a weighted ball that was movable within a housing having spherically shaped ends, thereby producing the tumbling action; however, since the center of gravity of the weighted ball when it was located in an end position was substantially the same as the center of the outside curves of the housing ends, the toy was less likely to move in the tumbling action to an upright position as the energy in the rolling ball was expended. Although the prior known constructions did produce the tumbling action by the transmittal of energy through the ball as it traveled down the tube toward the spherical ends, the prior known tumbling toys were less likely to execute the tumbling action except after only one or two rotations. Further, because of the relationship of the center of gravity of the ball and the center of the outside curve of the spherical end walls, the prior known constructions were likely to come to rest in a horizontally disposed position as opposed to a vertical upright position that would occur if the weighted ball were located at the bottommost end of the housing.

SUMMARY OF THE INVENTION

The present invention relates to a tumbling toy that comprises a hollow housing having spaced, opposed spherically formed end caps. An outer cylindrical sleeve is located between the end caps and an inner tubular member is positioned within the outer sleeve in co-axial relation with respect thereto and is secured at the ends thereof to the end caps. A weighted ball is captured for movement within the inner tubular member and end caps and rolls from one end cap to the other, and due to the energy generated by the ball the housing is caused to move in a tumbling end-over-end action. The geometry of the wall of the spherical end caps is such that the center of the mass of the ball when it is located in an end cap is below the geometric center thereof. By locating the center of the mass of the ball below the geometric center of the end caps as each end cap reaches the lower position during the tumbling action, the housing will always locate itself in a positive upright position after the tumbling action has discontinued.

Accordingly it is an object of the present invention to provide a tumbling toy having spherical end caps between which a tubular member is located, a weighted ball having rolling movement between the end caps, and the center of the mass of the ball being located below the geometric center of the spherical end caps when the toy is located in an upright position, wherein a positive tumbling end-over-end action is produced when an exterior force is applied to the toy or when the toy is placed on a downwardly inclined surface, the relationship of the center of the ball to the geometric center of the end caps also insuring that the toy always locates itself in a positive upright position after the tumbling is discontinued.

Other objects, features and advantages of the invention shall become apparent as the description thereof proceeds when considered in connection with the accompanying illustrative drawing.

DESCRIPTION OF THE DRAWING

In the drawing which illustrates the best mode presently contemplated for carrying out the present invention:

FIG. 1 is a perspective view of the tumbling toy as embodied in the subject invention and showing the toy as located on a rocking member;

FIG. 2 is a bottom plan view of the rocking member;

FIG. 3 is a elevational view of the tumbling toy;

FIG. 4 is a sectional view taken along line 4—4 in FIG. 3; and

FIG. 5 is a exploded perspective view of the tumbling toy.

DESCRIPTION OF THE INVENTION

The tumbling toy as embodied in the present invention is illustrated in FIGS. 3, 4 and 5 and is generally indicated at 10. As will be described hereinafter, the tumbling toy 10 may be used in a play action manner with a rocking member generally indicated at 12, the rocking member 12 being illustrated in FIGS. 1 and 2. Referring again to FIGS. 3, 4 and 5, the tumbling toy 10 is defined by a generally cylindrical housing that is comprised of spaced identically formed end caps generally indicated at 14, an inner tubular member 16, an outer tubular sleeve 18 and an inner tubular sleeve 20. As will be described, a weighted ball 22 is located interiorly of the tubular member 16 and has rolling movement to and from the end caps 14, wherein the weighted ball 22 promotes an end-over-end rolling action for the tumbling toy when a force is applied thereto or it is placed upon a downwardly inclined surface.

As more clearly illustrated in FIG. 4, each of the end caps 14 is formed in a hemispherical configuration and includes a rounded end wall 24. The curvature of the interior surface of the end wall 24 is defined by striking a radius from a center point indicated at 26, which as illustrated in FIG. 4 is located vertically above the center of gravity or center point 28 of the weighted ball 22 when the ball 22 is located in the lowermost end cap 14. As will be described, the relationship of the points 26 and 28 insures that the toy 10 will remain in an upright position after it has come to rest following a tumbling action.

Formed in the end caps 14 as part of the interior construction and adjacent to the interior edge thereof is an annular notch that defines an annular shoulder 30. The annular shoulder 30 as located in each of the end caps 14 receives the adjacent outermost annular edge of the tubular member 16 in positive engagement therewith to form an interior trackway for the ball 22. Formed on the end of each end cap 14 that is opposite to the rounded end walls 24 thereof is an annular reduced neck section 32 that defines a second annular shoulder 34. The shoulder 34 as formed in each of the end caps 14 is dimensioned to receive the outermost edges of the outer sleeve 18 and inner sleeve 20 thereagainst, as also illustrated in FIG. 4. As is more clearly illustrated in FIG. 5, the outer tubular member 18 is formed of a clear plastic material, and as will also be described, is of a dimension to space the end caps 14 apart to provide the cylindrical configuration for the toy as illustrated in FIGS. 1 and 3.

The outer sleeve 18 is also formed in a manner that insures that the toy will not remain on its side in a horizontal position, but will tumble to its opposite end for location in an upright position when the toy reaches the end of its tumbling action. As will be described, the rolling weighted ball 22 insures that the housing will end in an upright position. In order that the toy not remain on its side, the outer surface of the sleeve 18 is formed with a convex configuration, the curvature thereof conforming and blending with the adjacent rounded end walls 24 of the end caps 14.

In order to enhance the ornamental characteristics and play value of the tumbling toy 10, the inner sleeve 20, which may be formed of a thin sheet of plastic material is provided with ornamental characters or the like thereon. Other indicia or graphic display may be imprinted on the exterior surface of the inner sleeve 20, and since this sleeve is located interiorly of the clear plastic sleeve 18, the graphic display or characters as imprinted on the exterior surface of the inner sleeve 20 are visible through the sleeve 18.

In order to assemble the tumbling toy 10, the inner tubular member 16 is placed within one of the end caps 14, the edges of the member 16 being secured by an adhesive or by sonic welding on the shoulder 30 of the corresponding end cap. The ball 22 is then placed within the tubular member 16 and is captured therein. Thereafter the inner sleeve 20 is placed interiorly of the outer sleeve 18 and in contacting relation with the interior surfaces thereof, whereupon the graphics or display material as imprinted on the interior sleeve 20 are visible through the clear plastic outer sleeve 18. The inner and outer sleeves are then threaded over the inner tubular member 16 for engagement with the shoulder 34 of the end cap to which the tubular member 16 has been secured. The inner edges of the inner sleeve 20 may be secured to the contacting surface of the neck section 32 and shoulder 30 for restricting the inner sleeve 20 against movement relative to the outer sleeve 18. The edges of the outer tubular member 18 are purposely not secured to the shoulder 34 so as to provide for free rotating movement of the outer sleeve 18 relative to the inner sleeve 20 and the end caps 14.

The final assembly of the unit is accomplished by locating the other end cap 14 in place on the inner tubular member 16, with the adjacent edge of the inner tubular member 16 fixed to the corresponding shoulder 30 as formed in this latter end cap. The outer sleeve 18 and inner sleeve 20 are also located over the reduced section 32 of the latter end cap, the edges of the inner sleeve being secured to the corresponding shoulder 34 of the latter end cap. Again, the edges of the outer sleeve 18 are allowed to remain free with respect to the shoulder 34 of the latter end cap so as to provide free rotating movement of the outer sleeve 18 relative to the inner sleeve and end caps. The contacting surfaces of the inner tubular member 16 and the shoulders 30 of the end caps 14 may be secured together by an adhesive or by sonic welding to seal the housing of the tumbling toy together. In this position, the outer tubular sleeve 18 is rotatable relative to end caps 14 and also with respect to the inner tubular sleeve 20. If desired, a portion of the outer sleeve 18 may be formed with an opaque portion or may be painted or blanked out to allow only a portion of the graphic or ornamental material as it appears on the inner sleeve 20 to be visible. Thus rotation of the outer sleeve 18 will expose through the visible portion thereof a selected part of the graphic material as it is imprinted on the inner sleeve 20.

In use of the toy, an end-over-end motion is applied thereto by merely imparting an exterior force to the housing, or the toy can be placed on the inclined surface and caused to roll downwardly thereon. As the weighted ball 22 rolls from one end cap 14 through the tubular member 16 to the other end cap 14, the energy that is transmitted by the ball as it is urged through the inner tubular member, causes the ball to impact against the inner surfaces of the end caps, thereby transmitting the energy to the end caps for producing the end-over-end tumbling action. By forming the outer surface of the sleeve 18 with a curvature and by locating the geometric center of each of the spherical end caps 14 above the center of the ball 22 when the ball is located in the lowermost position as shown in FIG. 4, the movement of the toy off its side and the positioning of the toy in an upright position when it reaches the end of its rolling action, is assured. Thus, regardless of the amount of tumbling turns that the toy is caused to take during the play action thereof, it will always end in an upright position, with the weighted ball disposed in the lowermost of the end caps.

On occasions it may be desirable to utilize the toy 10 with the rocking member 12 since the tumbling toy will be confined on the rocking member. Referring now to FIGS. 1 and 2, the rocking member as illustrated includes a curved platform 38 to which sidewalls 40 are integrally joined. The lateral dimension of the platform 38 and as bounded by the sidewalls 40 provide for receiving the tumbling toy 10 on the platform for rolling movement thereon. Joined to the platform 38 and to the sidewalls 40 at the ends thereof are upstanding stops 42 that have a curved configuration for accommodating the end walls 14 of the tumbling toy 10 when the tumbling toy is propelled into engagement therewith. Joined to the end of the platform 38 and extending outwardly from the stops 42 are finger rests 44 that enable the user to rock the platform 38 back and forth thereby causing the tumbling toy 10 to move backwardly and forwardly on the curved platform in an end-over-end tumbling action.

The tumbling toy 10 may be used separate and apart from the rocking member 12 and may be propelled over a flat surface by imparting a forward motion thereto, or rolled downwardly on an inclined surface, the movement of the weighted ball 22 within the inner tubular member 16 causing the toy 10 to execute an end-over-end tumbling action as the energy transmitted by the mass of the ball moves from one end cap to the other. The clear outer sleeve 18 not only protects the inner plastic sleeve 20 but may also limit visibility to selection areas of the inner sleeve. Since the outer sleeve is rotatable relative to the inner sleeve, interesting and varied graphics may be visible through the clear section of the outer sleeve 18 as desired.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A tumbling toy, comprising a hollow housing that includes spaced, opposed end caps and an outer cylindrical sleeve located therebetween, each of said end caps having a hemispherical configuration that includes a rounded end wall, an inner tubular member located within said outer sleeve in coaxial relation thereto and being secured at the ends thereof to said end caps, the opposed ends of said inner tubular member extending inwardly within the opposed end caps for engagement with an interior portion of said end caps, and a weighted ball captured within said inner tubular member and end caps and having rolling movement between said end caps to produce a tumbling end-over-end action for said housing when an exterior force is applied thereto, or when said toy is placed on a downwardly inclined surface.

2. A tumbling toy as claimed in claim 1, the radius of curvature of the rounded end walls of said end caps being greater than the radius of said ball.

3. A tumbling toy as claimed in claim 1, the center of gravity of said ball when located in one of said end caps being located on the longitudinal axis of said inner sleeve and below the geometric center of a hemispherical end cap when the housing is located in an upright position and the ball is at the lowermost end thereof.

4. A tumbling toy as claimed in claim 1, an inner sleeve located interiorly of said outer sleeve and in engagement with the interior surface thereof, at least a portion of said outer sleeve being formed of a clear material and said inner sleeve having an ornamental display imprinted thereon that is visible through the clear portion of said outer sleeve.

5. A tumbling toy, comprising a hollow housing that includes spaced, opposed end caps and an outer cylindrical sleeve located therebetween, each of said end caps having a hemispherical configuration that includes a rounded end wall, an inner tubular member located within said outer sleeve in coaxial relation thereto and being secured at the ends thereof to said end caps, and a weighted ball captured within said inner tubular member and end caps and having rolling movement between said end caps to produce a tumbling end-over-end action for said housing when an exterior force is applied thereto, or when said toy is placed on a downwardly inclined surface, said end caps having inner end portions formed thereon of reduced diameter relative to the diametrical dimension of said end caps, said inner end portions defining annular shoulders against which the outermost edges of said outer sleeve are received in engaging relation, the outer diameter of said outer sleeve corresponding substantially to that of the diametrical dimension of said end caps.

6. A tumbling toy as claimed in claim 5, an inner sleeve located interiorly of said outer sleeve and in engagement with the interior surface thereof, said inner sleeve having a longitudinal dimension corresponding to that of said outer sleeve and an ornamental display imprinted thereof, said outer sleeve being formed of a clear material that provides for visual access to the ornamental display on said inner sleeve.

7. A tumbling toy as claimed in claim 6, the center of gravity of said ball when located in an end cap being located on the longitudinal axes of said inner sleeve and at a point more closely adjacent to the end wall of the end cap in which said ball is located than the center point from which the radius of curvature of an end cap is measured.

8. A tumbling toy, comprising a hollow housing that includes spaced, opposed end caps and an outer cylindrical sleeve located therebetween, each of said end caps having a hemispherical configuration that includes a rounded end wall, an inner tubular member located within said outer sleeve in coaxial relation thereto and being secured at the ends thereof to said end caps, and a weighted ball captured within said inner tubular member and end caps and having rolling movement between said end caps to produce a tumbling end-over-end action for said housing when an exterior force is applied thereto, or when said toy is placed on a downwardly inclined surface, an annular shoulder formed interiorly of each end cap, the largest diameter of which corresponds to the diameter of the outer surface of said tubular member that is received in engaging relation on the annular shoulders formed in said end caps.

9. A tumbling toy as claimed in claim 8, an inner sleeve located interiorly of said outer sleeve in engagement with the interior surface and having an ornamental display imprinted thereon, said outer sleeve being formed of a clear plastic material that provides for visual access to the ornamental display on said inner sleeve.

10. A tumbling toy as claimed in claim 9, an annular notch being formed on the outer surface of the wall of each end cap opposite to the rounded end walls thereof, each of said annular notches defining an annular shoulder in each end cap that receives the ends of said inner and outer sleeves thereagainst.

11. A tumbling toy as claimed in claim 1, a rocking member having a platform that is generally arcuate in configuration with the ends thereof curving upwardly, side edges formed on said platform which is of a lateral dimension to accommodate said housing therebetween, said rocking member being movable in a rocking action to cause said housing to move in an end-over-end back and forth motion on said platform.

12. A tumbling toy as claimed in claim 11, upstanding end stops located at the ends of said platform and preventing said housing from rolling thereoff.

13. A tumbling toy, comprising a hollow housing that includes spaced, opposed end caps and an outer cylindrical sleeve located therebetween, each of said end caps having a hemispherical configuration that includes a rounded end wall, an inner tubular member located within said outer sleeve in coaxial relation thereto and being secured at the ends thereof to said end caps, and a weighted ball captured within said inner tubular member and end caps and having rolling movement between said end caps to produce a tumbling end-over-end action for said housing when an exterior force is applied thereto, or when said toy is placed on a downwardly inclined surface, the outer surface of said outer sleeve having a convex configuration that insures that the toy will move from a horizontal position as the weighted ball rolls between the end caps.

* * * * *